US009040798B2

(12) United States Patent
Ho et al.

(10) Patent No.: US 9,040,798 B2
(45) Date of Patent: May 26, 2015

(54) INFLATABLE ELECTRONIC DRUM SET

(71) Applicant: Tien-Hwa Ho, New Taipei (TW)

(72) Inventors: Tien-Hwa Ho, New Taipei (TW); Hai-Ning Ho, New Taipei (TW); Kuei-Ting Ho, New Taipei (TW)

(73) Assignee: Tien-Hwa Ho, New Taiepei (TW)

( * ) Notice: Subject to any disclaimer, the term of this patent is extended or adjusted under 35 U.S.C. 154(b) by 0 days.

(21) Appl. No.: 14/523,947

(22) Filed: Oct. 27, 2014

(65) Prior Publication Data

US 2015/0114210 A1 Apr. 30, 2015

(30) Foreign Application Priority Data

Oct. 28, 2013 (TW) ..... 102219999 U

(51) Int. Cl.

| | |
|---|---|
| ***G10D 13/02*** | (2006.01) |
| ***G10H 3/14*** | (2006.01) |
| ***G10D 13/06*** | (2006.01) |
| ***G10D 13/00*** | (2006.01) |

(52) U.S. Cl.

CPC ..... *G10D 13/024* (2013.01); *G10H 3/146* (2013.01); *G10D 13/02* (2013.01); *G10D 13/06* (2013.01); *G10D 13/065* (2013.01); *G10D 13/006* (2013.01)

(58) Field of Classification Search

USPC ..... 84/412, 420

See application file for complete search history.

(56) References Cited

U.S. PATENT DOCUMENTS

| | | | | | |
|---|---|---|---|---|---|
| 881,109 | A * | 3/1908 | Cipar | 84/412 |
| 1,478,757 | A * | 12/1923 | O'Connor | 446/222 |
| 3,250,843 | A * | 5/1966 | Jenny | 84/711 |
| 3,541,913 | A * | 11/1970 | Severino | 84/413 |
| 4,246,824 | A * | 1/1981 | Hanson et al. | 84/336 |
| 4,289,056 | A * | 9/1981 | Shier | 84/412 |
| 4,704,934 | A * | 11/1987 | Nosrati | 84/94.2 |
| 4,745,839 | A * | 5/1988 | Peraino | 84/411 M |
| 5,108,338 | A * | 4/1992 | Margolis | 446/220 |
| 5,392,681 | A * | 2/1995 | Hall | 84/413 |
| 5,587,543 | A * | 12/1996 | Da Silva Marques | 84/411 M |
| 5,782,668 | A * | 7/1998 | Chabert | 446/220 |
| 6,031,168 | A * | 2/2000 | Damm | 84/380 B |
| 6,198,033 | B1 * | 3/2001 | Lovelett | 84/411 R |

(Continued)

OTHER PUBLICATIONS

Inflatable drum advertisement https://www.youtube.com/watch?v=dyf5SyK-BJA viewed online on Dec. 24, 2014.*

(Continued)

*Primary Examiner* — David Warren
(74) *Attorney, Agent, or Firm* — Leong C. Lei

(57) ABSTRACT

An inflatable electronic drum set includes an inflatable bladder, which when inflated, forms a three-dimensional outer configuration of a combination of a drum set and including multiple structural sections of drums and cymbals. The interior is filled up with air and each drum surface or cymbal surface is provided with a pressure detection film, so that through settings made with a control module, when a drummer hits, a corresponding drum sound or cymbal sound is generated. The inflated music instruments are set at positions corresponding to those of a traditional drum set. Due to high resiliency and flexibility, percussion can be made with perfect hand perception and no concern about collision and tumbling may be caused. Another advantage is that the sound volume can be adjusted. In addition, after air is completely discharged, the drum set can be stowed in a very limited space.

11 Claims, 5 Drawing Sheets

(56) References Cited

U.S. PATENT DOCUMENTS

| | | | | |
|---|---|---|---|---|
| 6,225,540 | B1 * | 5/2001 | Arias Fernandez et al. | 84/380 B |
| 6,291,752 | B1 * | 9/2001 | Vergara | 84/411 R |
| 6,386,938 | B1 * | 5/2002 | Novak et al. | 446/186 |
| 6,482,065 | B1 * | 11/2002 | Blackman | 446/220 |
| 6,483,017 | B1 * | 11/2002 | Dill et al. | 84/411 R |
| 7,077,553 | B2 * | 7/2006 | Vanderschuit | 362/565 |
| 7,551,061 | B2 * | 6/2009 | Blackman | 340/384.6 |
| 7,611,395 | B2 * | 11/2009 | Bonsembiante | 446/220 |
| 7,674,152 | B2 * | 3/2010 | Anderson | 446/220 |
| 8,895,827 | B1 * | 11/2014 | Grossman | 84/411 M |
| 8,933,310 | B2 * | 1/2015 | Rogers | 84/104 |
| 2006/0090628 | A1 * | 5/2006 | Yeh | 84/380 R |
| 2007/0068364 | A1 * | 3/2007 | Sharp | 84/411 R |

OTHER PUBLICATIONS

Inflatable drum advertisement http://www.alibaba.com/product-detail/2014-new-style-fashion-kids-inflatable_1698556873.html viewed online on Dec. 24, 2014.*

Inflatable drum advertisement http://www.landmarkcreations.com/inflatable-products-gallery/product-replicas/item/drum-set-l1792viewed online on Dec. 24, 2014.*

Inflatable drum advertisement http://store.drumbum.com/skuPRC-14.html viewed online on Dec. 24, 2014.*

* cited by examiner

INFLATABLE ELECTRONIC DRUM SET

BACKGROUND OF THE INVENTION (a) Technical Field of the Invention

The present invention generally relates to a combination of a drum set made up of an inflatable plastic or flexible bladder, which after being inflated, forms a three-dimensional configuration of a drum set comprising shapes of various music instruments of drums and cymbals distributed on the bladder with separate pressure detection films attached to surfaces of the music instruments that are shaped through inflation, whereby when a drummer hits the surfaces of the drums or the cymbals with a drumstick or a hand, different sound effects are generated and respectively correspond to the sounds of the instruments of the drum set.

(b) Description of the Prior Art

A traditional drum set includes a bass drum, a floor tom, a snare drum, left and right toms, ride and splash cymbals, and a hi-hat, of which the installation requires a large amount of space. On the other hand, an electronic drum uses pressure detection to allow for interaction of percussion with a user, but it does not look like a true drum and does not match the traditional drum set in hitting position so that it often leads to incorrect habit of hitting after long term practice.

SUMMARY OF THE INVENTION

The drum set has been long necessary and primary percussion instruments for musicians. Rhythms and music that touch and move people can be played by simply hand holding drumsticks to hit different types of music instruments of drums and cymbals. Due to the characteristic of being easy to learn and practice and attracting the attention of young children, the drum set has been spread from the European and American countries to the Asian countries, brining on a new trend of learning jazz drumming all around the world.

A traditional drum set usually includes numerous various music instruments of drums and cymbals that are put together to make a drum kit. Typically, there are seven or eight pieces of instrument, including a bass drum, a floor torn, left and right tomes, a ride cymbal, a splash cymbal, and a hi-hat. These instruments, after being properly installed, occupy a great amount of space. However, most of the modern urban residences are often of limited spaces, making it not possible for those interested in learning and playing the instruments to have their dreams come true. In addition, the jazz drumming, when being played, often produces extreme high-level noise and the neighborhood usually does not tolerate such noises. This makes people losing their opportunities of learning and practicing jazz drumming. Recently, the progress of electronic technology brings the developments of various electronic drum kits, of which the overall size is greatly reduced. Most of these electronic drums are installed by being positioned on a frame and they are also referred to as a drum kit. Further, they allows for adjustment of the volume level. This makes them better suit the needs of the urban residents for using these types of electronic drums to practice and play. There is also thin sheet type electronic drum simulation plate, which comprises thin-sheet pressure detection plate to simulate different types of drums and allows for practicing and playing by being placed on a desktop.

However, both the electronic drums that are positioned on a frame and the thin-sheet type electronic drums that are positionable on a desktop are not true drums. For most drummer or player, it is easy for them to get used to habits of hitting incorrect positions and bad movements of playing after long term practice with such types of electronic drums. Such hitting positions of the electronic drums do not allow the player to apply to the traditional drums. Further, the electronic drum kits, although being smaller in size, still occupy quite an amount of space. These music instruments are generally made of rigid components of hardware and it is easy to get hurt for young children, who often get accidentally tumbled or colliding these rigid and hard instruments.

The present invention provides a novel idea and structure, which uses an inflatable three-dimensional configuration of a dram set to overcome the above-discussed drawbacks of the traditional drum set or electronic drums. The inflatable form of drum set requires only an inflatable/deflatable plastic bladder to form an outer configuration similar to a traditional drum set and a sheet of pressure detection film is attached to each drum surface or cymbal surface. Through setting of a controller or a microprocessor, when a drummer hits each drum or cymbal, a sound effect of a corresponding drum sound or a cymbal sound is produced. The positions of the inflated drums and cymbals are arranged to be identical to those of the traditional drum set so that an advantage of being consistent in spatial positions with the traditional drum set is achieved and an additional advantage of volume or sound effect being adjustable similar to that of an electronic drum set is also provided. After air is completely discharged or evacuated, the inflatable drum set can be completely stowed in a very limited space. In addition, the inflatable electronic drum set, after being inflated, behaviors just like an inflatable toy, showing high resiliency and flexibility thereby causing no concern about collision and tumbling, making it perfectly suit for practicing of young children and professional performance of adults. It can be expected that this is a very ideal novel product.

The present invention provides a structure that comprises various drum models and cymbal models, which generally include a bass drum, a floor torn, a snare drum, a right torn, a left tom, a ride cymbal, a splash cymbal, and a hi-hat, which are collectively formed as a configuration of a traditional drum set and, specifically, all the music instruments included are formed of an inflatable bladder in such a way that the bass drum is operated with a traditional bass drum pedal and the hi-hat is operated with a hi-hat pedal, wherein air cells or air compartments are in communication with each other and connection is made with a fixing frame and a chair to improve the stabilization thereof and adjustment of the portions thereof is allowed for being set at proper positions. The inflatable bladder comprises an air valve, which receives air charged through foot-stepping pumping, electrical pumping, or even a pressurized air canister. The inflatable bladder is additionally provided with an inflatable chair with the air compartments being connected together and in communication with each other so that when a person sits on the inflatable chair, the air pressure in the other portions is caused to raise, making all the portions of the inflatable bladder that form the drums and cymbals more saturated and better tensioned during performances.

Further, the inflated bladder may form various percussion music instruments. Since the drum surfaces or cymbal surfaces are inherently of resiliency, making them perfectly meet the desired physical property, hitting the inflated electronic drum provides a rebounding force that cannot be provided by the conventional electronic drums. Sound magnification of the sound speaker may be achieved with a space formed with the inflated bladder to form a sound box resonance chamber, which may effectively generate all sorts of sounding effect of bass tones so that a relatively smaller sound speaker can be used to replace the woofer speaker of a conventional electronic drum.

Thus, various advantages of the present invention can be achieved with a simply-structured inflatable bladder, where a traditional drum set and electronic drums are combined to provide an ideal and practical effect of use. Since the present invention has a very low cost and is easy to implement, it is an invention of practical values of use and a detailed description of an embodiment thereof will be given as follows.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
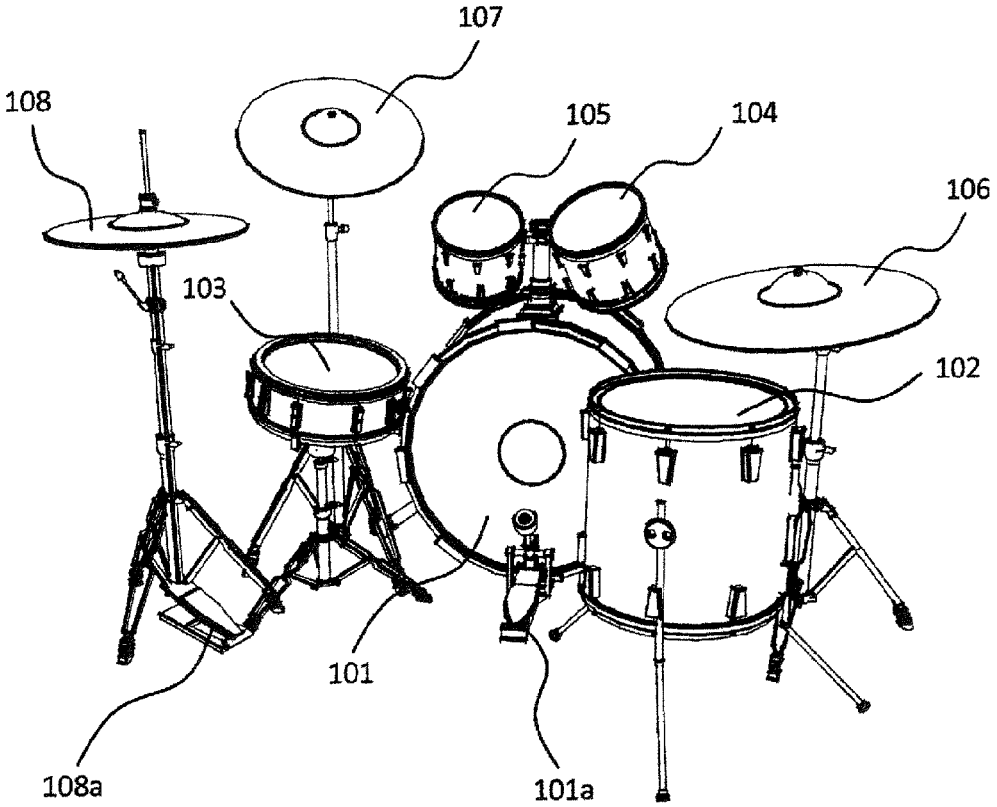
FIG. 1 is a schematic view illustrating instruments of a conventional jazz drum set.
Figure 2:
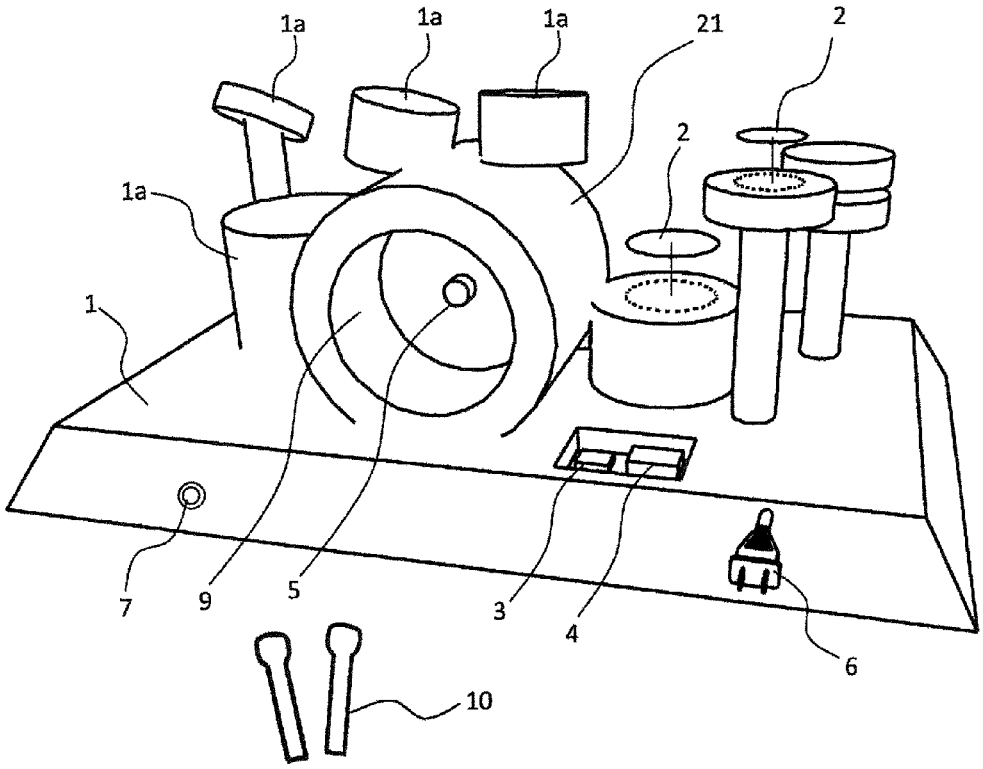
FIG. 2 is a schematic view illustrating major functions of the present invention.
Figure 3:
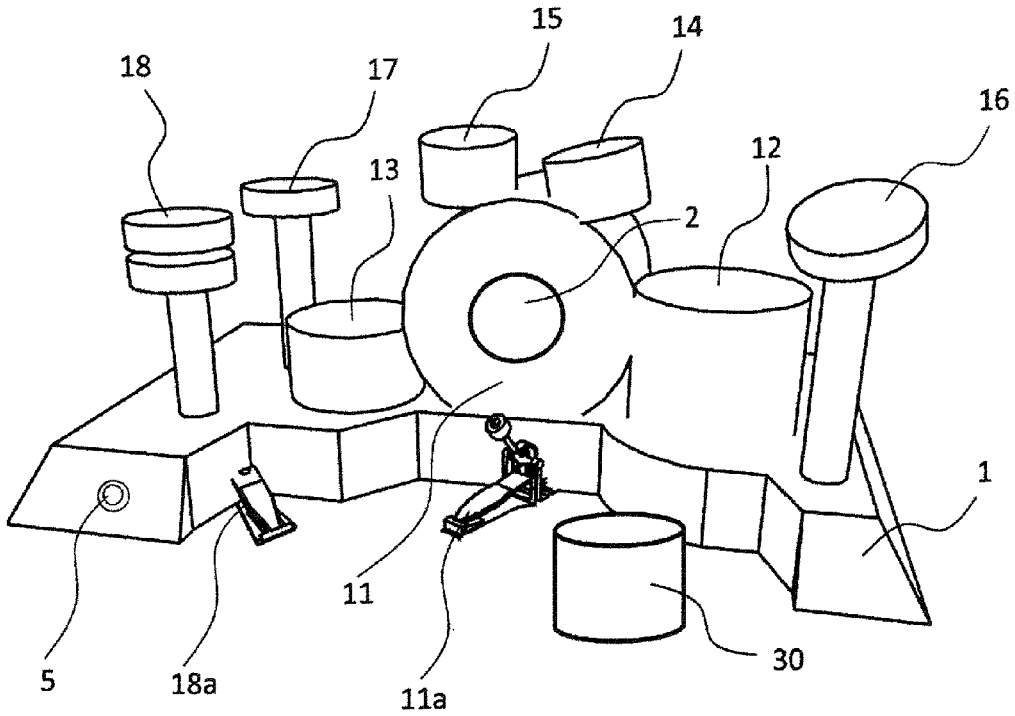
FIG. 3 is a schematic view illustrating a first embodiment of the present invention.
Figure 4:
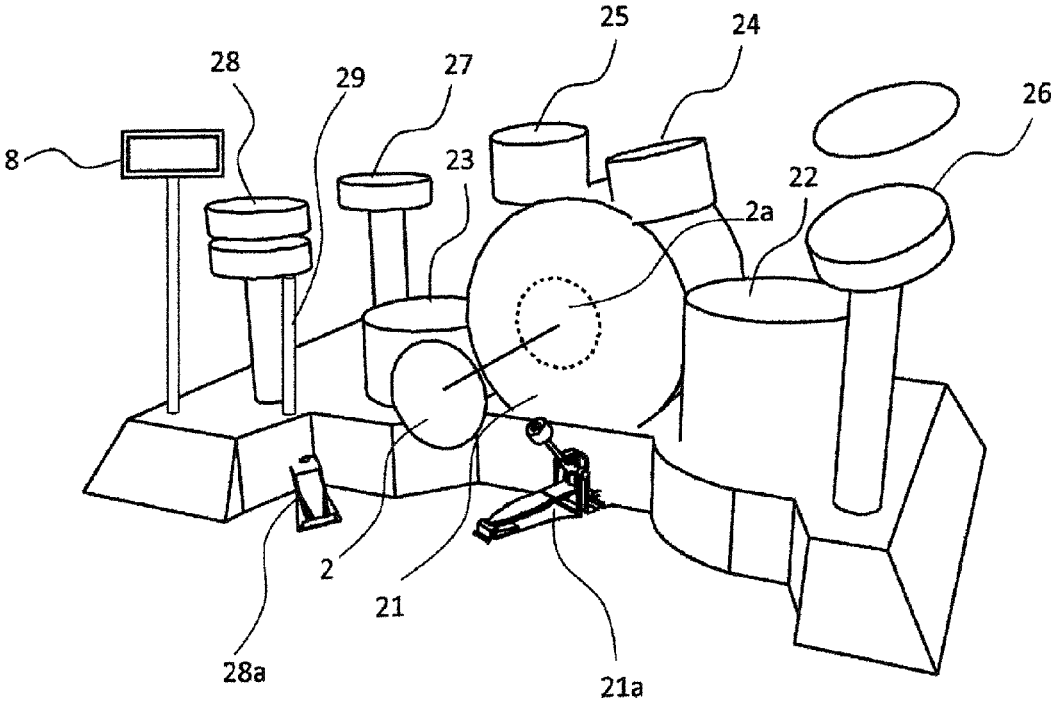
FIG. 4 is a schematic view of the present invention illustrating a display device and a transmission mechanism are included.
Figure 5:
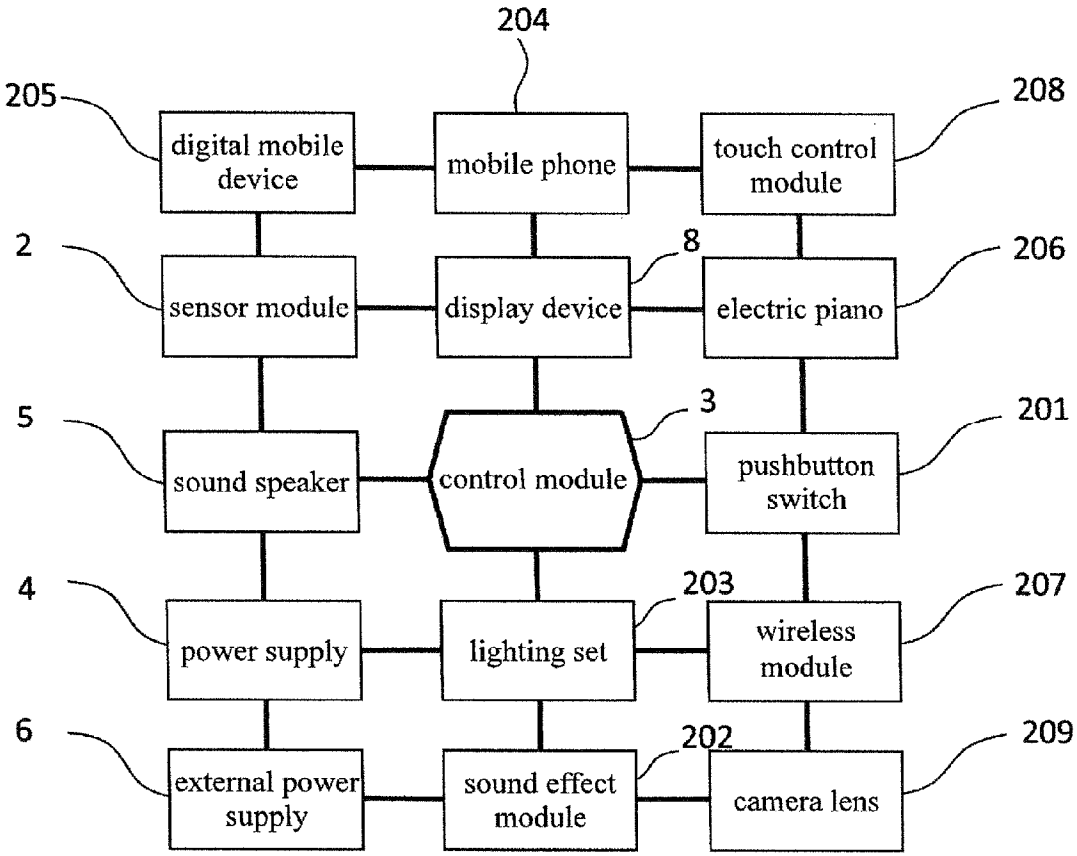
FIG. 5 is a schematic block diagram of a circuit of the present invention.

Referring to FIG. 1, a traditional drum set is generally composed of a traditional bass drum 101, a traditional floor tom 102, a traditional snare drum 103, a traditional right tom 104, a traditional left tom 105, a traditional ride cymbal 106, a traditional splash cymbal 107, and a traditional hi-hat 108. The present invention, however, as shown in FIG. 2, comprises an inflatable electronic drum set, which is generally composed of an inflatable bladder 1, a sensor module 2, a control module 3, a power supply 4, and a sound speaker 5. The inflatable bladder 1 comprises a bladder that has a hollow interior and is charged with air and inflated to show an outer configuration of an entire combination of a drum set or a drum kit that comprises one or more structural sections resembling various forms of drum model sections or cymbal model sections 1*a*. The sensor module 2 can be arranged to be a single one or plural ones respectively attached to drum surfaces or cymbal surfaces or arranged in the interiors or peripheries of the drum models or cymbal models 1*a* of the inflatable bladder 1 to detect the pressure or action of pressing, abrading, or hitting the inflatable drums or inflatable cymbals. The control module 3 is connected to the sensor modules 2, so that when the sensor modules 2 that are attached to the drum models or cymbal models 1*a* are subjected to variation of pressure, sound signals corresponding to the drums or cymbal models 1*a* are produced and transmitted to the sound speaker 5, where a corresponding sound of music is given off. The power supply 4 supplies electrical power and can be made up of a traditional battery or a rechargeable battery and an external power supply 6 may be used, where electricity from an electric main or green energy is supplied to suit the need of electrical power. The green energy may include a known power source, such as solar panel or wind power generation. The sound speaker 5 can be arranged around a periphery of the inflatable bladder or connection through cabled measure or wireless measure to an external speaker device can be employed to achieve the same function, whereby when the sensor modules 2 detect movements of pressing, abrading, or hitting, the sound speaker 5 is signaled to give off a corresponding sound of music.

The periphery of the inflatable bladder 1 is provided with at least one air valve 7 in fluid communication with the interior space thereof so that an external air supply can charge air through the air valve 7 into the inflatable bladder for inflation and shaping. After being properly shaped, the inflatable bladder is inflated to show one or more projecting or raised portions resembling various forms of drum models or cymbal models 1*a*, so that the entirety of the shape is similar to a three-dimensional combination of a drum set or an electronic drum kit. It is also feasible to make drawings of drums or cymbals on the corresponding structural sections of the drum models or cymbal models 1*a* of the inflatable bladder 1. Since the inflatable bladder 1 can define, through inflation, the positions of the drums and cymbals of a drum set, it can provide similar positions as those of the traditional drums and cymbals of a traditional drum set so that it is possible to better match the habit of playing for a drummer or player. Further, when the portions of the inflatable bladder 1 have been fully charged and inflated, proper resiliency is induced to allow the perception of hitting with a drumstick 10 similar to playing a traditional drum with a similar reaction force induced for percussion. The sensor modules 2 can be properly set to detect different magnitudes of forces so that it is possible to the magnitude of a force applied by a player to make the sound speaker 5 giving off sounds of different volumes or different sound effects. The air valve 7 can be arranged to be a single one or plural ones distributed on the periphery of the inflatable bladder 1 or mounted to peripheries of the drum models or cymbal models 1*a*, or can alternatively be arranged as a large vent hole, allowing for fast discharge of air to efficiently reduce the overall size for easy carrying and storage.

Referring to FIGS. 2-5, the inflatable bladder 1 may comprise an inflatable pad or partition to form, on the periphery of the inflatable bladder 1, a partitioned inflatable compartment sound box resonance chamber 9, such as at the site of the inflated bass drum 21, wherein the sound speaker 5 is positioned so as to facilitate improvement of echoing and resonating effect of the sound speaker 5. It is also feasible to use an independent and separate inflatable structure or non-inflatable structure as a substitute. Further, it is also feasible to provide a pushbutton switch 201 or a sound effect module 202 in the control module 3 to allow a user to adjust the output level of sound volume, to input various device for generating various sound effects, to activate an operation of sound recording, to activate multimedia interactive music playing, or to initiate automatic tutorial functions.

The sensor module 2 is made up of a detective thin sheet or detective thin film and may alternatively be composed of a pressure, vibration, or sound based sensor. The detection achieved with such a sensor can be resistive, capactive, or optical. The sensor can be mounted to a detection position 2*a* on each of the inflated drums or cymbals to detect the pressure or movement caused by pressing or hitting and providing a feedback signal with or without magnitude of force transmitted to the control module 3. The sensor module 2 may adopt a direct pressure detection manner in order to isolate vibration generated by and transmitted from other portions. The power supply 4 may be a battery or a rechargeable mobile power supply. The external power supply 6 can be connected to an electric main or a commonly used rectifier transformer.

The inflatable bladder 1 is structured to form various structural sections of drum models or cymbal models 1*a*, which may include a bass drum 21, a floor tom 22, a snare drum 23, a right tom 24, a left tom 25, a ride cymbal 26, a splash cymbal 27, and a hi-hat 28, which collectively make up a drum set. The primary idea of the present invention is to provide such a drum set by using an inflated bladder, in which the music instruments of drums and cymbals can be of various combinations of different numbers of instruments, allowing for increasing or decreasing the numbers of the drum instruments and/or cymbal instruments. The bass drum 21 may be provided for use in combination with one or more bass drum pedals 21*a* and the hi-hat 28 can be used in combination with one or more hi-hat pedals 28*a*. The interior air compartments of these portions can be made in communication with each other, or alternatively, a combination of individually inflated drums and cymbals may be provided, which may even be used in combination with traditional drums and cymbals. The inflatable bladder 1 or each individual drum and/or cymbal may be combined together with hook-and-loop fasteners or buckles or may be combined with a supporting frame or a chair to improve stability thereof and also for adjusting the positions of each portions to a proper location. The air valve 7 of the inflatable bladder 1 may receive air supplied from a foot-stepping type pump, an electrical pump, or even a pressurized air canister. The inflatable bladder 1 is provided an additional space for accommodating and combination with an electric plano 206 or all kinds of music instrument for being used collectively to play music. Further, the inflatable bladder 1 is provided with an inflatable chair 30, which comprises air compartments that can be in communication with each other and those of other portions. When a person sits on the inflatable chair 30, the air pressure inside the other portions is increased so that these portions of drums and cymbals of the inflatable bladder 1 so formed may be more saturated and better tensioned during performances.

The combination of drums and cymbals formed with the inflatable bladder 1 can be of different sizes to suit different heights of adults and children. The inflatable bladder 1 can be made of a light-transmitting or opaque material and a lighting set 203 composed of various colors may be arranged inside or outside the inflatable bladder 1 to provide a lighting effect that may be in synchronization with the drum sounding or music played therewith. Further, the hi-hat 28 has a structure of which inflated portions are made up of multiple sheets or are movable up and down, so that when the hi-hat pedal 28*a* is treaded, a linkage mechanism 29 or an air pressure conduit is operated to drive up and down movement of the inflated portions of the hi-hat 28 for opening and closing. The control module 3 is operable to switch the sounding modes of the hi-hat 28 according to the movement thereof so that different sounds may be given off when a drummer or player hits the hi-hat 28. The hi-hat pedal 28*a* and the bass drum pedal 21*a* may be coupled through the same treading mechanism to an air pumping device so that one pedal can be used to operate the bass drum or cymbal type instruments and can also serve as a foot-stepping pumping device in time when inflation is needed.

The sound speaker 5 can be a cabled or wireless sound speaker 5 or speaker set and cabled or wireless connection can be established to transmit sound signals to a remote site. The wireless transmission may include Bluetooth, Wi-Fi, a mobile phone 204, and a digital mobile device 205, allowing for easy broadcasting of the sound through other sounding systems. Further, the control module 3 can be connected, in a cabled or wireless manner, to the mobile phone 204 or the digital mobile device 205 so that with corresponding Apps being installed in the mobile phone 204 or the digital mobile device 205, the mobile phone 204 or the digital mobile device 205 can be used to execute desired controls, installations, and transmissions or to serve as a display device for interaction. Further, the mobile phone 204 or the digital mobile device 205 may be used to simulate the generation of various sound effects or to serve as an output device of sound effects. Thus, a user may use the mobile phone 204 or the digital mobile device 205 as a synchronous control center of the electronic drum set. Further, multiple mobile phones 204 or multiple digital mobile devices 205 may be used collectively to simulate various music instruments of the drum sets or electronic drums.

The control module 3 can be a computer, a microprocessor, a controller, or any kinds of digital devices that is connected to at least a display device 8. The display device 8 may comprises a touch control module 208 or a camera lens 209, so that a user may use the display device 8 to enter various settings or to execute image recognition based real-time interaction. The display device 8 may respond to various conditions of use or interact with a user through multimedia information or to operate in synchronization with the lighting set 203 to remind a drummer or player to timely hit the music instruments. The control module 3 may provide interactive tutorial through the display device 8 or simulate the functions of all kinds of metronome or practice pad to allow a drummer or player to practice playing of all sorts of percussion instruments.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An inflatable electronic drum set, comprising:

an inflatable bladder, which comprises a bladder that has a hollow interior and is chargeable with air and inflatable to show an outer configuration of a drum set or a drum kit or an entire combination thereof that comprises one or more structures resembling various forms of drum models and cymbal models;

a sensor module, which is selectively arranged to be a single one or plural ones respectively attached to drum surfaces and cymbal surfaces or arranged in interiors or peripheries of the drum models and cymbal models of the inflatable bladder to detect pressure or action of pressing, abrading, or hitting the inflatable drums and inflatable cymbals;

a control module, which is connected to the sensor module so that when the sensor module attached to the structures of the drum models or cymbal models is subjected to variation of pressure, a sound signal corresponding to the drums or cymbal models is produced and transmitted to a sound speaker, where a corresponding sound is given off;

a power supply, which comprises a battery or a rechargeable battery or an external power supply having electricity supplied from an electric main or green energy for supplying electrical power required; and a sound speaker, which is arranged around a periphery of the inflatable bladder or is structured to have connection in a cabled fashion or a wireless fashion to an external speaker device, whereby when the sensor module detects pressing, abrading, or hitting, the sound speaker is signaled to give off a corresponding sound.

2. The inflatable electronic drum set according to claim 1, wherein a periphery of the inflatable bladder is provided with at least one air valve in fluid communication with the interior space thereof so that an external air supply charges air through the air valve into the inflatable bladder for inflation and shaping and after being shaped, the inflatable bladder is inflated to show one or more projecting or raised portions resembling various forms of drum models or cymbal models, so that the entirety of the shape is similar to a three-dimensional combination of a drum set or an electronic drum kit, drawings of drums or cymbals being selectively formable on the corresponding drum models or cymbal models of the inflatable bladder, whereby since the inflatable bladder defines, through inflation, positions of the drums and cymbals of a drum set, similar positions as those of traditional drums and cymbals of a traditional drum set may be provided so that better matching of the habit of playing for a drummer or player is achievable and when the portions of the inflatable bladder are fully charged and inflated, resiliency is induced to allow for perception of hitting with a drumstick similar to playing a traditional drum with a similar reaction force induced for percussion, the sensor module being be properly set to detect different magnitudes of forces so that the magnitude of a force applied by a player makes the sound speaker giving off sounds of different volumes or different sound effects, the air valve being arranged to be a single one or plural ones distributed on the periphery of the inflatable bladder or mounted to peripheries of the drum models or cymbal models, or being arranged as a large vent hole, allowing for fast discharge of air to efficiently reduce the overall size for easy carrying and storage.

3. The inflatable electronic drum set according to claim 1, wherein the inflatable bladder comprises an inflatable pad or partition to form, on the periphery of the inflatable bladder, a partitioned inflatable compartment sound box resonance chamber, such as at the site of the inflated bass drum, wherein the sound speaker is positioned so as to facilitate echoing and resonating effect of the sound speaker, the position being alternatively an independent and separate inflatable structure or non-inflatable structure, a pushbutton switch and a sound effect module being connected to the control module to allow a user to adjust the output level of sound volume, to input various device for generating various sound effects, to activate an operation of sound recording, to activate multimedia interactive music playing, or to initiate automatic tutorial functions.

4. The inflatable electronic drum set according to claim 1, wherein the sensor module is made up of a detective thin sheet or detective thin film or alternatively be composed of a pressure, vibration, or sound based sensor, the detection achieved with such a sensor being resistive, capactive, or optical, the sensor being mounted to a detection position on the inflated drums or cymbals to detect the pressure or movement caused by pressing or hitting and providing a feedback signal with or without magnitude of force transmitted to the control module, the sensor module alternatively adopting a direct pressure detection manner in order to isolate vibration generated by and transmitted from other portions, the power supply being a battery or a rechargeable mobile power supply, the external power supply being connected to an electric main or a rectifier transformer.

5. The inflatable electronic drum set according to claim 1, wherein the structures of drum models or cymbal models of the inflatable bladder include a bass drum, a floor tom, a snare drum, a right tom, a left tom, a ride cymbal, a splash cymbal, and a hi-hat, or include a combination of different numbers, the bass drum being operable in combination with one or more bass drum pedals, the hi-hat being operable in combination with one or more hi-hat pedals, the air compartments of these portions being in communication with each other, or alternatively, a combination of individually inflated drums and cymbals being provided, the inflatable bladder or the individual drums and/or cymbals being combined together with hook-and-loop fasteners or buckles or being selectively combined with a supporting frame or a chair to improve stability thereof, the air valve of the inflatable bladder receiving air supplied from foot-stepping air pumping, electrical air pumping, or a pressurized air canister, the inflatable bladder being provided an additional space for accommodating and combination with an electric plano or all kinds of music instrument for being used collectively, the inflatable bladder being provided with an inflatable chair, which comprises air compartments in communication with each other and those of other portion so that when a person sits on the inflatable chair, the air pressure inside the other portions is increased whereby the drum set formed of the inflatable bladder gets more saturated and better tensioned during performances.

6. The inflatable electronic drum set according to claim 5, wherein the combination of drums and cymbals formed with the inflatable bladder is selectively of different sizes to suit different heights of adults and children, the inflatable bladder being selectively made of a light-transmitting or opaque material, a lighting set of various colors arranged inside or outside the inflatable bladder to provide a lighting effect that is selectively set in synchronization with the drum sounding or music played therewith for automatic tutorial, the hi-hat having a structure of which inflatable portions are made up of multiple sheets or are movable up and down, so that when the hi-hat pedal is treaded, a linkage mechanism or an air pressure conduit is operated to drive up and down movement of the inflatable portions of the hi-hat for opening and closing, the control module being operable to switch sounding modes of the hi-hat according to the movement thereof so that different sounds are given off when a drummer or player hits the hi-hat.

7. The inflatable electronic drum set according to claim 5, wherein the hi-hat pedal or the bass drum pedal is coupled through the same treading mechanism to an air pumping device so that one pedal is used to operate the bass drum or cymbal type instruments and also to serve as a foot-stepping pumping device in time when inflation is needed.

8. The inflatable electronic drum set according to claim 1, wherein the sound speaker is selectively a cabled or wireless sound speaker or speaker set, cabled or wireless connection being established to transmit sound signals to a remote site, the wireless transmission including Bluetooth, Wi-Fi, a mobile phone, and a digital mobile device, allowing for easy broadcasting of the sound through other sounding systems, the control module being connected, in a cabled or wireless manner, to the mobile phone or the digital mobile device so that with corresponding Apps being installed in the mobile phone or the digital mobile device, the mobile phone or the digital mobile device is used to execute desired controls, installations, and transmissions or to serve as a display device for interaction, the mobile phone or the digital mobile device being used to simulate the generation of various sound effects or to serve as an output device of sound effects, whereby a user uses the mobile phone or the digital mobile device as a synchronous control center of the electronic drum set and multiple mobile phones or multiple digital mobile devices are used collectively to simulate various music instruments of the drum sets or electronic drums.

9. The inflatable electronic drum set according to claim 1, wherein the control module is selectively a computer, a microprocessor, a controller, or any kinds of digital devices that is connected, in a cabled fashion or a wireless fashion, to at least a display device, the display device comprising a touch control module or a camera lens, so that a user uses the display device to enter various settings or to execute image recognition based real-time interaction, the display device being operable to respond to various conditions of use or interact with a user through multimedia information, the control module being operable to provide interactive tutorial through the display device or to operate in synchronization with the lighting set to remind a drummer or player to timely hit the music instruments, or to simulate the functions of all kinds of metronome or practice pad so as to allow a drummer or player to practice playing of all sorts of percussion instruments and allows for sound and image recording.

10. The inflatable electronic drum set according to claim 5, wherein the hi-hat pedal or the bass drum pedal comprises circuit simulation through the sensor module to obtain movement reaction of a foot of a user and generates, through the control module, sound signals of various drum models or cymbals to be transmitted to the sound speaker for giving off corresponding sounds, whereby the hi-hat pedal or the bass drum pedal uses a circuit of the sensor module to control sound without physical contacting.

11. The inflatable electronic drum set according to claim 2, wherein the periphery of the inflatable bladder comprises one or more projection portions connectable with one or more other music instruments so that the outer configuration, in the entirety thereof, shows a combination of a drum set and a plano, an electric plano, a guitar, or drum sets of different styles, wherein the projection portions are set in fluid communication with each other in order to reduce the number of air charging valves used or are individually inflatable through separate air valves.

* * * * *